United States Patent [19]

Baese et al.

[11] Patent Number: 4,507,040

[45] Date of Patent: Mar. 26, 1985

[54] METHOD AND APPARATUS FOR TRANSPORTING CIGARETTES OR THE LIKE BETWEEN PRODUCING AND PROCESSING MACHINES

[75] Inventors: Horst Baese; Gerhard Tolasch, both of Wentorf, Fed. Rep. of Germany

[73] Assignee: Hauni-Werke Körber & Co. KG., Hamburg, Fed. Rep. of Germany

[21] Appl. No.: 368,261

[22] Filed: Apr. 14, 1982

[30] Foreign Application Priority Data

Apr. 23, 1981 [DE] Fed. Rep. of Germany ..... 3116105

[51] Int. Cl.[3] ..... B65G 47/52

[52] U.S. Cl. ..... 414/403; 53/236; 131/283; 198/347; 414/786

[58] Field of Search ..... 414/403, 786; 198/347; 131/282, 283; 53/148, 236

[56] References Cited

U.S. PATENT DOCUMENTS

| | | | |
|---|---|---|---|
| 3,952,854 | 4/1976 | Selonke et al. | 198/524 X |
| 4,229,137 | 10/1980 | Molins | 414/786 |
| 4,316,754 | 2/1982 | Hinchcliffe et al. | 198/347 |
| 4,338,057 | 7/1982 | Molins | 414/403 X |
| 4,339,026 | 7/1982 | Bäse et al. | 198/347 |
| 4,365,703 | 12/1982 | Hinchcliffe et al. | 198/347 |

FOREIGN PATENT DOCUMENTS

| | | | |
|---|---|---|---|
| 2024758 | 1/1980 | United Kingdom | 414/403 |

*Primary Examiner*—Leslie J. Paperner
*Attorney, Agent, or Firm*—Peter K. Kontler

[57] ABSTRACT

A multi-layer stream of cigarettes is transported from a making machine to a packing machine by way of a first and a second junction. The first junction diverts some or all of the cigarettes from their path and into a tray filler when the output of the making machine exceeds the requirements of the packing machine, and the second junction receives some or all of the cigarettes from a magazine filler when the requirements of the packing machine exceed the output of the making machine. A trickle of cigarettes can flow into the tray filler and a trickle of cigarettes can flow from the magazine filler even at such times when the requirements of the packing machine match the output of the making machine. This prevents moving cigarettes from rubbing against one and the same group of stagnant cigarettes which fill the location where the first junction can discharge cigarettes into the tray filler and the location where the second junction can receive cigarettes from the magazine filler. Filled trays are transferred from the tray filler to the magazine filler, and empty trays are transferred from the magazine filler to the tray filler.

19 Claims, 2 Drawing Figures

METHOD AND APPARATUS FOR TRANSPORTING CIGARETTES OR THE LIKE BETWEEN PRODUCING AND PROCESSING MACHINES

CROSS-REFERENCE TO RELATED CASE

The description of the drawings in the present application is substantially identical with that of FIGS. 1 and 2 in the commonly owned copending application Ser. No. 368,312 filed by us on Apr. 14, 1982 for "APPARATUS FOR TRANSPORTING CIGARETTES OR THE LIKE BETWEEN PRODUCING AND CONSUMING MACHINES", now abandoned.

BACKGROUND OF THE INVENTION

The present invention relates to a method and apparatus for manipulating rod-shaped articles which constitute or form part of smokers' products. The articles under consideration here include plain or filter cigarettes, cigarillos or cigars as well as filter rod sections. More particularly, the invention relates to improvements in a method and apparatus for transporting rod-shaped articles (hereinafter called cigarettes or filter cigarettes) from one or more producing machines (such as one or more cigarette making or filter tipping machines) to one or more processing or consuming machines (such as reservoirs for temporary storage of cigarettes or packing machines). Still more particularly, the invention relates to improvements in a method and apparatus for transporting multi-layer streams or mass flows of cigarettes between producing and consuming or processing machines.

It is already known to provide a conveyor system, which connects a producing and a consuming machine, with one or more openings which can constitute inlets or outlets, i.e., which can allow for evacuation of surplus cigarettes from the path as well as for admission of cigarettes into the path, depending upon whether the output of the producing machine exceeds the requirements of the processing machine or vice versa. For example, the just mentioned opening can constitute the inlet-outlet opening of a first-in last-out reservoir of the type known as surge bin. The surge bin can temporarily store the surplus of cigarettes and discharges its contents into the path between the producing and processing machines when the requirements of the processing machine exceed the output of the producing machine. Surge bins which are capable of being utilized in systems under discussion here are known in the industry under the name RESY.

The command signals for removal of cigarettes from their path between the producing and processing machines or for readmission of cigarettes into such path are normally transmitted by suitable sensor means, e.g., by mechanical sensors resting on and being responsive to the pressure of cigarettes in the region of the inlet-outlet opening. It is equally possible to install suitable monitoring devices close to the producing and/or processing machine. A drawback of presently known methods and apparatus of the just outlined character is that cigarettes are likely to be damaged in the region where the surplus is removed from or where cigarettes are admitted into the path between the producing and processing machines. The primary reason for damage is that cigarettes which continue to advance along their path rub against stationary cigarettes in the inlet-outlet opening with attendant likelihood of damage to the wrappers of cigarettes which move relative to each other. The likelihood of damage is particularly pronounced when a particular group or layer of stationary cigarettes is immediately adjacent to the stream of cigarettes advancing from the producing to the processing machine. This will be readily appreciated since such stationary cigarettes come into contact with successive cigarettes of the nearest layer of advancing cigarettes and their wrappers are likely to be damaged or destroyed after a reasonably short interval of time, especially if the stationary layer is located at a level below a relatively high multi-layer stream of continuously advancing cigarettes.

OBJECTS AND SUMMARY OF THE INVENTION

An object of the invention is to provide a novel and improved method of manipulating cigarettes or analogous rod-shaped articles between producing and processing machines in such a way that the cigarettes are unlikely to be damaged on their way to the processing machine irrespective of whether they are transported to such machine directly or indirectly.

Another object of the invention is to provide a method which reduces the number of cigarettes which move with reference to each other.

A further object of the invention is to provide a novel and improved method of preventing stagnation of cigarettes on their way from the producing to the processing or consuming machine.

Still another object of the invention is to provide a novel and improved method of temporarily storing the surplus of cigarettes between producing and processing machines.

A further object of the invention is to provide a novel and improved apparatus for the practice of the above outlined method, and to construct and assemble the apparatus in such a way that it treats the cigarettes gently and reduces the likelihood of relative movement between neighboring layers or strata of cigarettes on their way from the producing to the processing machine.

An additional object of the invention is to provide the apparatus with novel and improved means for temporarily storing the surplus of cigarettes between the producing and processing machines.

Still another object of the invention is to provide the apparatus with novel and improved controls for the means which accept the surplus from and which admit articles to the stream flowing between the producing and the processing machines.

A further object of the invention is to provide an apparatus which allows for continuous circulation of the surplus of rod-shaped articles between the producing and consuming machines adjacent to the path along which the bulk of articles advances from the producing to the consuming machine.

An additional object of the invention is to provide a novel and improved combination of a tray filling and evacuating system with the conveyor system which transports a multi-layer stream of cigarettes or analogous rod-shaped articles between a cigarette making machine and a packing or other processing machine.

A further object of the invention is to provide a transporting apparatus wherein cigarettes or analogous rod-shaped articles advance sideways from a producing to a processing machine and pass through one or more junctions, and to construct the junctions and regulate the flow of articles through the junctions in such a way that they are not likely to deface, deform and/or otherwise damage the articles which pass therethrough.

One feature of the invention resides in the provision of a method of transporting multi-layer streams of rod-shaped articles of the tobacco processing industry to and from at least one junction. The method comprises the steps of conveying to the junction a first article stream at a variable rate, conveying from the junction a second article stream at a variable rate, and continuously diverting from the junction a third article stream when the first stream is larger than the second stream or continuously admitting to the junction a third article stream when the second stream is larger than the first stream.

The method can further comprise the steps of increasing the speed of transport of one of the first and second streams to a predetermined maximum value and simultaneously reducing the third stream to a mere trickle so that the quantity of articles transported by the other of the first and second stream per unit of time approximates but is slightly less than the quantity of articles transported by the one stream per unit of time.

If the method involves transporting multi-layer streams of articles to and from the one as well as to and from a second junction, the first stream is conveyed to the one junction, the second stream is conveyed from the one to the second junction, and the third stream is diverted from the one junction. The method then further comprises the step of admitting to the second junction a fourth article stream and withdrawing from the second junction a fifth stream. The just mentioned method can further comprise the step of introducing the articles of the third stream into successive empty chargers or trays. The fourth stream can be built from the contents of successive filled chargers or trays to thereby empty such trays. The conversion of the contents of filled trays into the fourth stream takes place at a first location (e.g., in or at the magazine of a magazine filler), and the conversion of the third stream into the contents of successive filled trays takes place at a second location. The method then further comprises (or can further comprise) the steps of transferring empty trays from the first to the second location and transferring filled trays from the second to the first location.

Another feature of the invention resides in the provision of an apparatus for transporting multi-layer streams of rod-shaped articles of the tobacco processing industry. The apparatus comprises a conveyor system which defines an elongated path, and a switching device or the like serving to define in the path a junction with two inlets and one outlet or vice versa. The conveyor system includes first conveyor means for delivering to the junction a first article stream at a variable rate along the path and second conveyor means for removing from the junction a second article stream at a variable rate along the path. The apparatus further comprises compensating means which continuously diverts from the junction a third article stream when the first stream is larger than the second stream or which continuously admits to the junction a third article stream when the second stream is larger than the first stream. The apparatus also comprises regulating means for the compensating means; the regulating means is operative to keep the third stream flowing as long as at least one of the first and second streams keeps flowing. The regulating means can comprise means for reducing the third stream to a mere trickle when the quantity of articles which one of the first and second streams transports per unit of time is increased to a maximum value so that the quantity of articles which the other of the first and second streams then transports per unit of time rises to a value which is only slightly less than the maximum value.

The apparatus can further comprise a second switching device or analogous means which defines in the path a second junction disposed downstream of the first mentioned junction, as considered in the direction of flow of the first and second streams. The second conveyor means then advances the second article stream from one outlet of the first junction to one inlet of the second junction and the conveyor system then further comprises third conveyor means for removing from the second junction a fourth stream along the path. The compensating means of such apparatus includes means for diverting the third stream from the first junction and means for admitting a fifth article stream to the second junction. The diverting or removing means can comprise a tray filler, and the admitting means can comprise a magazine filler. Such apparatus can further comprise means for transferring filled trays from the tray filler to the magazine filler for conversion of the contents of filled trays into the fifth stream, and means for transferring the thus emptied trays to the tray filler.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
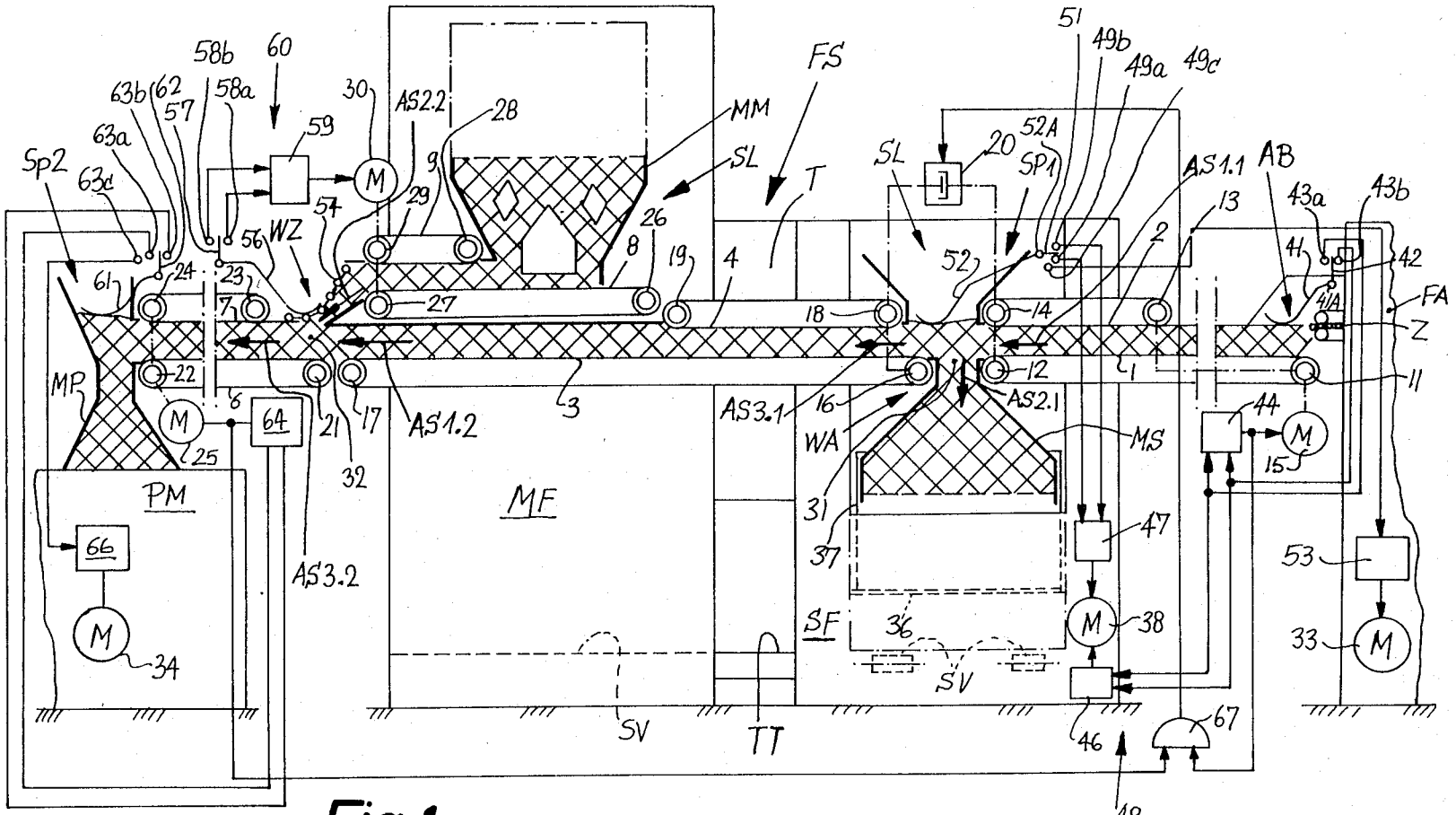
FIG. 1 is a schematic elevational view of an apparatus which embodies one form of the invention, portions of the producing and processing machines being broken away.

The apparatus which is shown in FIG. 1 transports a multi-layer stream or mass flow of filter cigarettes Z from a first or producing machine FA (here shown as a filter tipping machine, for example, of the type known as MAX or MAX S produced and distributed by the assignee of the present application) and a second or processing machine PM, for example, a packing machine for filter cigarettes. The composite conveyor system which defines an elongated path for the transport of a multi-layer stream of cigarettes Z from the machine FA to the machine PM is denoted by the reference character FS. This path extends from an article gathering station AB at the outlet of the filter tipping machine FA, past a first switching or diverting device WA which can divert articles from the elongated path into a removing means SF in the form of a tray filler, and past a second switching device WZ which can admit a second multi-layer stream of cigarettes into the elongated path for advancement into the magazine MP of the processing or packing machine PM. The cigarettes Z move sideways, i.e., at right angles to their longitudinal axes.

The conveyor system FS comprises several groups of cooperating endless belt conveyors including a first pair of such conveyors which are denoted by the reference characters 1 and 2 and define a first section of the elongated path, namely, the section extending between the article gathering station AB and the inlet or opening 31 defined by the switching device WA. A second pair of endless belt conveyors 3 and 4 defines a second section of the elongated path, namely, that section which extends between the switching devices WA and WZ. A third pair of endless belt conveyors 6 and 7 defines a further section of the path, namely, the section which extends from the the second switching device WZ to the inlet of the magazine MP forming part of the packing machine PM. The belt conveyors 1 and 2 are respectively trained over pulleys 11, 12 and 13, 14. The pulleys 11 and 13 can be driven by a first prime mover in the form of an electric motor 15. The belt conveyors 3 and 4 are respectively trained over pulleys 16, 17 and 18, 19. The pulleys 16 and 18 can be mechanically coupled with the pulleys 12 and 14 by an electromagnetic clutch 20 adapted to receive signals from a sensor 52 at the locus of the switching device WA. The belt conveyors 6 and 7 are respectively trained over pulleys 21, 22 and 23, 24. The pulleys 21 and 23 can be driven by a second prime mover in the form of an electric motor 25. The belt conveyors 1, 2, 3, 4, 6 and 7 can constitute toothed belts; in such conveyor system, the pulleys 11, 12, 13, 14, 16, 17, 18, 19, 21, 22, 23 and 24 are provided with suitable teeth to prevent slippage of the respective belts. The teeth on the belt conveyors do not affect the condition of the cigarettes Z in the elongated path because the conveyors offer smooth surface for contact with the cigarettes in the adjacent layers of the multi-layer stream.

The tray filler SF, which receives a multi-layer cigarette stream via inlet 31 defined by the switching device WA, can be of the type known as HCF manufactured and sold by the assignee of the present application and described in U.S. Pat. No. 4,207,720 granted Jan. 17, 1980 to Tolasch et al. The disclosure of this patent, as well as the disclosure of each other U.S. patent mentioned herein, is incorporated by reference.

The second switching device WZ is adjacent to an article admitting means in the form of a magazine filler MF having a magazine or reservoir MM adapted to be filled with cigarettes Z supplied by trays or chargers 37 which, in turn, are filled at the station or location accommodating the tray filler SF. The outlet of the magazine MM of the magazine filler MF can discharge a multi-layer stream of cigarettes Z by way of a channel or passage defined by two endless belt conveyors 8 and 9 which are respectively trained over pulleys 26, 27 and 28, 29. The pulleys 27 and 29 can be driven by a third prime mover here shown as an electric motor 30. The magazine filler MF may be of the type known as MAGOMAT which is manufactured and sold by the assignee of the present application and is described in U.S. Pat. No. 3,777,911 granted Dec. 11, 1973 to Bornfleth.

The first article stream which is transported by the belt conveyors 1, 2 from the gathering station AB to the first junction defined by the first switching device WA is shown at AS 1.1. The arrow AS 2.1 denotes a second multi-layer stream which branches off the stream AS 1.1 at the switching device WA by flowing downwardly through the inlet 31 and into the tray filler SF. The multi-layer stream which flows from the switching device WA to the switching device WZ is shown at AS 3.1.

The stream AS 3.1 also constitutes one of the streams (namely, the stream AS 1.2) flowing toward a second junction 32 which is defined by the switching device WZ. The junction 32 further receives a second stream AS 2.2 which is delivered by the belt conveyors 8, 9 from the magazine MM of the magazine filler MF. The stream AS 3.2 is the one which leaves the junction 32 and flows into the magazine MP of the packing machine PM.

FIG. 1 shows that the conveyors 3 and 4 establish a connection between the junctions defined by the switching devices WA and WZ; these conveyors transport the stream AS 3.1, i.e., the stream AS 1.2 which normally advances along the elongated path toward the second junction 32.

A prime mover 33, e.g., an electric motor, drives the moving parts of the filter tipping machine FA, and a further prime mover 34, e.g., an electric motor, drives the moving parts of the packing machine PM. The tray filler SF comprises a reciprocable horizontal bottom wall or platform 36 which carries a tray 37 during filling with cigarettes entering such tray via inlet 31. The means for moving the bottom wall 36 comprises a lowering drive 38, for example, a drive of the type disclosed in the aforementioned U.S. Pat. No. 4,207,720. A magazine MS of the tray filler SF receives cigarettes Z via inlet 31 for admission into a tray 37 on the platform 36.

The tray filler SF and the magazine filler MF comprise or are adjacent to stations SL for empty trays as well as to stations SV for filled trays. The two stations SL for empty trays and the two stations SV for filled trays are respectively connected to each other by two transferring devices T and TT. The transferring device T is located at a level above the elongated path which is defined by the conveyor system SF, and the other transferring device TT is disposed at a level below such path. Similar connections between a tray filler and a magazine filler are disclosed in the aforementioned U.S. Pat. No. 3,777,911. Each of the transferring devices T and TT can employ belt conveyors which extend transversely of the respective stations SL and SV.

The operation of the motor 15 for the pulleys 11 and 13 of the belt conveyors 1 and 2 is regulated by a sensor 41 which is installed at the gathering station AB and rests on the topmost layer of the stream AS 1.1. The sensor 41 is a mechanical sensor which is pivotable at 41A and has a flag or trip 42 movable between two proximity detector switches **43*a* and 43*b*. The purpose of the switches 43*a* and 43*b* is to respectively connect and disconnect the motor 15 from an energy source 44. The motor 38 for lowering the platform 36 of the tray filler SF is designed to lower the platform at a very low speed when it is connected to an energy source 46. In addition, the motor 38 is connectable with a second energy source 47 which ensures a more rapid lowering of the platform 36, namely, a downward movement of the platform at a customary or normal speed. The energy source 46 is controlled by the proximity detector switches 43*a* and 43*b*, i.e., by the sensor 41 at the gathering station AB. The proximity detector switches 43*a* and 43*b*, together with the energy source 46, can be said to constitute a regulating or control unit 48 for the motor 38**.

The energy source 47 can be connected with or disconnected from the motor 38 by proximity detector switches 49*a*, 49*b* which are actuatable by a trip 51 forming part of the sensor 52 in the region of the first switching device WA. The sensor 52 is pivotable at 52A and is responsive to the pressure of cigarettes Z at a level above the inlet 31. More specifically, the sensor 52 extends into a cigarette storing area SP1 which is disposed above the inlet 31 and can receive cigarettes Z when the rate at which the belt conveyors 1, 2 deliver cigarettes to the switching device WA exceeds the rate at which the cigarettes leave this switching device through the passage between the belt conveyors 3, 4 as well as via inlet 31. As a rule, the storing area SP1 receives cigarettes Z when an exchange of trays 37 takes place in the tray filler SF, namely, when a freshly filled tray 37 is replaced with an empty tray. At such times, the multi-layer stream AS 2.1 ceases to flow downwardly through the inlet 31 and into the tray filler SF.

The trip 51 of the sensor 52 can further cooperate with a third proximity detector switch 49*c* which serves to disconnect an energy source 53 for the motor 33 of the filter tipping machine FA when the uppermost layer of cigarettes in the storing area SP1 reaches a level which is indicative of maximum filling of the apparatus and of the need to interrupt the admission of cigarettes Z from the tipping machine FA into the gathering station AB. Such situation can develop when the tray filler SF functions improperly and must be arrested to carry out the necessary repair work.

In the region of the switching device WZ, the topmost layer of cigarettes Z in the junction 32 supports a flexible membrane 54 one end of which is secured to the frame of the apparatus and which carries horizontal bars serving to prevent uncontrolled rolling of cigarettes in this region. More specifically, the membrane 54 prevents uncontrolled rolling of cigarettes between the outlet of the passage which is defined by the belt conveyors 8, 9 and the belt conveyors 6, 7. The membrane 54 supports the curved end portion of a pivotable sensor 56 which monitors the height of the stack of articles in the junction 32 and has a flag or trip 57 cooperating with two proximity detector switches 58*a* and 58*b*. The proximity detector switches 58*a* and 58*b* respectively serve to connect or disconnect an energy source 59 from the motor 30 which drives the conveyor belts 8 and 9. The energy source 59 and the proximity detector switches 58*a*, 58*b* together constitute a regulating or control unit 60 for the motor 30.

A further pivotable sensor 61 is provided in the cigarette storing area Sp2 at a level above the magazine MP of the packing machine PM. The sensor 61 is lifted when the height of the stack of cigarettes Z in the storing area Sp2 increases, and its trip 62 is movable between two proximity detector switches 63*a*, 63*b* which respectively connect or disconnect an energy source 64 from the motor 25 which drives the belt conveyors 6 and 7. The trip 62 of the sensor 61 can further actuate a third proximity detector switch 63*c* which then disconnects an energy source 66 from the motor 34 which drives the movable component parts of the packing machine PM. This takes place when the supply of cigarettes Z in the storing area Sp2 is depleted so that the packing machine PM does not receive an adequate supply of cigarettes.

The energy sources 44 and 64 are connected with the clutch 20 by a logic circuit here shown as an AND gate 67. The arrangement is such that the clutch 20 is engaged when the belt conveyors 1, 2 are driven by the motor 15 and the belt conveyors 6, 7 are driven by the motor 25. In other words, the clutch 20 is engaged when the switching device WA receives the stream AS 1.1 and the switching device WZ delivers a stream AS 3.2 of cigarettes Z toward the sensor 61. This means that, under such operating conditions, the belt conveyors 3 and 4 are driven via clutch 20 and deliver the stream AS 3.1 from the junction which is defined by the switching device WA toward the junction 32 which is defined by the switching device WZ. Such kinematic connection between the belt conveyors 1, 2 and 3, 4 via clutch 20 ensures that the stream AS 3.1 (corresponding to the stream AS 1.2) is advanced from the switching device WA toward the switching device WZ.

The mode of operation of the apparatus which is shown in FIG. 1 is as follows:

It is now assumed that the filter tipping machine FA turns out cigarettes Z at the rate at which such cigarettes are processed by the packing machine PM. In other words, it is assumed that an equilibrium exists between the output of the machine FA and the requirements of the machine PM. The sensor 41 monitors the position of the uppermost layer of cigarettes Z at the gathering station AB and its trip 42 regulates the operation of the motor 15 by way of proximity detector switches 43*a*, 43*b* and energy source 44 in such a way that the belt conveyor 1 carries and advances a multilayer stream AS 1.1 of constant or nearly constant height. Such stream is delivered to the first switching device WA.

The sensor 61 in the storing area Sp2 above the magazine MP of the packing machine PM monitors the level of the uppermost layer of cigarettes Z, and its trip 62 cooperates with the proximity detector switches 63*a*, 63*b* and energy source 64 to regulate the operation of the motor 25 and hence the belt conveyors 6 and 7 in such a way that the storing area Sp2 contains a substantially constant quantity of cigarettes Z. The output signals of the energy sources 44 and 64 are transmitted to the corresponding input of the AND gate 67, and the output signal of the gate 67 energizes the clutch 20 which establishes a kinematic connection between the belt conveyors 1, 2 and 3, 4.

In addition to controlling the motor 15, the sensor 41 also controls the energy source 46 for the motor 38 which lowers the platform 36 in the tray filter SF. The energy source 46 is constructed, assembled and connected with the motor 38 in such a way that the platform 36 and the tray 37 thereon descends at a very low speed. Such lowering of the tray 37 below the switching device WA ensures that the stream AS 1.1 is divided into (a) a relatively or extremely small stream AS 2.1 trickling into and beyond the inlet 31 (namely, into the magazine MS and thence into the descending tray 37) and (b) a stream AS 3.1 which is transported by the belt conveyors 3 and 4 toward the junction WZ. The quantity of cigarettes Z in the stream AS 2.1 can constitute a minute fraction of cigarettes which constitute the stream AS 3.1. However, this is amply sufficient to ensure that no cigarette will dwell at the inlet 31 for an extended period of time so that such cigarette cannot be contacted by a large number of cigarettes which advance from the passage between the belt conveyors 1, 2 toward the passage between the belt conveyors 3, 4. The height of the stream AS 3.1 is less than the height of the stream AS 1.1 because the quantity of cigarettes in unit lengths of the stream AS 3.1 is less (due to diversion of some cigarettes into the inlet 31, i.e., due to formation of the stream AS 2.1). However, it is also possible to form a stream AS 3.1 having a height which is identical with that of the stream AS 1.1 by the simple expedient of driving the belt conveyors 3, 4 at a speed which is less than the speed of the conveyors 1, 2 so as to account for deflection of the stream AS 2.1 into the tray filler SF.

If the output of the filter tipping machine FA matches or closely approximates the requirements of the packing machine PM, the quantity of cigarettes in successive increments of the stream AS 3.2 exceeds the quantity of cigarettes in successive increments of the stream AS 1.2 (corresponding to the stream AS 3.1) because the stream AS 3.2 is composed of the streams AS 1.2 and AS 2.2. The flow of cigarettes which constitute the multi-layer stream AS 2.2 is regulated by the sensor 56 via proximity detector switches 58*a*, 58*b*, energy source 59 and motor 30 for the belt conveyors 8 and 9. The arrangement is such that the rate of delivery of cigarettes which form the stream AS 2.2 is substantially constant so that the sum of cigarettes in successive increments of the streams AS 1.2 and AS 2.2 matches the quantity of cigarettes in successive unit lengths or increments of the stream AS 3.2. The stream AS 2.2 is formed by cigarettes Z which are discharged by the magazine MM of the magazine filler MF, namely, by cigarettes from a filled tray 37 which has been delivered by the lower transferring device TT of FIG. 1 and whose contents have been transferred into the magazine MM. The evacuation of the contents of successive filled trays 37 into the magazine MM need not take place only at such times when the magazine MM is nearly or practically empty. In other words, this magazine can be filled to a predetermined level by evacuating the contents of successively delivered filled trays 37. The formation of a multi-layer stream AS 2.2 and the addition or admixture of such stream to the stream AS 1.2 ensures a continuous intermixing or exchange of cigarettes Z at the junction 32 which is defined by the second switching device WZ. Stagnation of cigarettes or cigarette layers at the junction 32 is undesirable because this can cause damage to stationary cigarettes as a result of repeated contact with advancing cigarettes, namely, with cigarettes which advance from the passage between the conveyors 3, 4 toward and into the passage between the conveyors 6 and 7.

Empty trays 37 which are delivered to the tray filler SF by the transferring device T are filled, one after the other, during downward movement with the platform 36, and successive filled trays 37 are accumulated at the station SV of the tray filler SF. Such filled trays 37 are taken over by the lower transferring device TT and are transferred from the station SV of the tray filler SF to the station SV of the magazine filler MF. Successive filled trays 37 are thereupon lifted above the station SV of the magazine filler MF for evacuation or transfer of their contents into the magazine MM.

If the packing machine PM fails to operate properly for any one of a variety of different reasons, its magazine MP ceases to receive filter cigarettes Z from the passage between the conveyors 6 and 7. This means that the level of the uppermost layer of cigarettes Z in the storing area Sp2 rises and the sensor 61 is pivoted in a clockwise direction, as viewed in FIG. 1. The sensor 61 causes the proximity detector switch 63*b* to disconnect the energy source 64 from the motor 25 and to thereby arrest the belt conveyors 6 and 7. In other words, delivery of the multi-layer stream AS 3.2 from the second switching device WZ toward the magazine MP is interrupted. At such time, the energy source 64 ceases to transmit a signal to the corresponding input of the AND gate 67 so that the clutch 20 is deenergized and the belt conveyors 3 and 4 are arrested. In other words, the junction 32 ceases to receive the stream AS 1.2. The magazine MM of the magazine filler MF continues to discharge the article stream AS 2.2 so that the sensor 56 is pivoted in a counterclockwise direction, as viewed in FIG. 1, and its trip 62 causes the proximity detector switch 58*b* to disconnect the energy source 59 from the motor 30 so that the conveyor belts 8 and 9 are arrested. This means that the junction 32 ceases to receive any cigarettes. Consequently, the level of the uppermost layer of cigarettes in the storage area SP1 above the inlet 31 in the region of the first switching device WA rises and the sensor 52 is pivoted in a clockwise direction whereby its trip 51 actuates the proximity detector switch 49*a* which connects the energy source 47 with the motor 38 so that the platform 36 of the tray filler SF begins to descend at a relatively high speed. This is necessary because the entire output of the filter tipping machine FA is then accepted by the tray filler SF which fills successive empty trays 37 in rapid sequence.

If the operation of the packing machine PM is interrupted for a longer period of time, the sum of filled trays at the stations SV of the fillers SF and MF can reach a number at which the stations SV are filled to capacity. In such instance, the filled trays at the station SV can be removed for transfer to another apparatus which requires additional cigarettes because its packing machine is operative while the filter tipping machine or another producing machine is idle for a relatively long period of time. The transfer of filled trays 37 from the station SV of the filler SF and/or MF to another apparatus can be effected by resorting to suitable wheel-mounted conveyances, for example, pushcarts of the type disclosed in commonly owned U.S. Pat. No. 3,519,143 granted July 7, 1970 to Kochalski et al. The utilization of such conveyances is desirable and advantageous because it ensures that the operation of the filter tipping machine FA need not be interrupted, even if the packing machine PM of FIG. 1 is idle for an extended period of time.

If a malfunction develops in the filter tipping machine FA, the supply of filter cigarettes Z at the gathering station AB is depleted and the sensor 41 is caused to pivot in a counterclockwise direction whereby its trip 42 actuates the proximity detector switch 43*a* which disconnects the energy source 44 from the motor 15 so that the belt conveyors 1 and 2 are arrested. At the same time, the proximity detector switch 43*a* disconnects the energy source 46 from the motor 38 so that the platform 36 of the tray filler SF is arrested. The signal at the output of the AND gate 67 also disappears because the energy source 44 ceases to transmit a signal to the motor 15 so that the clutch 20 is deenergized and the belt conveyors 3 and 4 come to a halt. Of course, the belt conveyors 3 and 4 are arrested anyway because the motor 15 is idle.

Since the switching device WZ ceases to receive the stream AS 1.2, the stream AS 3.2 which the second switching device WZ delivers to the magazine MP of the packing machine PM must be formed exclusively of cigarettes supplied by the magazine MM through the passage which is defined by the belt conveyors 8 and 9.

In other words, at such time the quantity of cigarettes Z per unit length of the stream AS 2.2 must match the quantity of cigarettes per unit length of the stream AS 3.2. This is effected by the sensor 56 whose trip 57 cooperates with the proximity detector switches 58*a* and 58*b* to connect or disconnect the energy source 59 from the motor 30 which drives the belt conveyors 8 and 9. The stream AS 2.2 is formed of cigarettes which are supplied by successive filled trays 37, namely, by the contents of trays which are delivered to the station SV of the magazine filler MF and are caused to discharge their contents into the magazine MM. It will be noted that the packing machine PM need not be arrested in response to short-lasting stoppages of the filter tipping machine FA. At such times, the magazine MP of the packing machine PM receives an adequate supply of cigarettes Z from the magazine MM of the magazine filler MF which, in turn, receives successive filled trays 37 from the station SV of the tray filler SF. The tray filler SF is idle because the motor 38 is disconnected from the energy source 46 as a result of engagement of the trip 42 of the sensor 41 with the proximity detector switch 43*a*. However, even longer-lasting interruptions of operation of the filter tipping machine FA can be compensated for by supplying the station SV of the magazine filler MF with filled trays from other tray fillers so that the magazine MM is continuously filled and can supply cigarettes through the passage between the conveyors 8 and 9 at a rate such that the stream AS 3.2 remains unchanged and the filler MF satisfies the requirements of the packing machine PM. The filler MF can receive filled trays 37 from other machines or from reservoirs by resorting to wheel-mounted conveyances in the form of wagons, pushcarts or the like. Reference may be had to the aforementioned commonly owned U.S. Pat. No. 3,519,143 to Kochalski et al.

The fillers SF and MF can be said to constitute a compensating unit which continuously diverts from the first junction a (third) stream (AS 2.1) when the first stream (AS 1.1) is larger than the second stream (AS 3.1), and which continuously admits to the second junction 32 a stream (AS 2.2) when the stream AS 3.2 is larger than the stream AS 1.2. The regulating means 48 and 60 ensure that the streams AS 2.1 and AS 2.2 keep flowing as long as at least one of the respective streams AS 1.1, AS 3.1 and AS 1.2, AS 3.2 keeps flowing. Otherwise stated, the regulating means 48 ensures that the stream AS 1.1 is larger than the stream AS 3.1 so that the stream AS 2.1 must be diverted into the tray filler SF under all operating conditions, and the regulating means 60 ensures that the stream AS 3.2 is larger than the stream AS 1.2 so that the stream AS 2.2 keeps flowing under all operating conditions. The velocity of the stream AS 2.2 can be reduced to a minimum value when the velocity of the stream AS 3.1 is increased to a maximum value, i.e., when the junction defined by the switching device WA should not divert cigarettes Z into the tray filler SF except on the ground that such diversion reduces the likelihood of damage to cigarettes in the region of the inlet 31. Analogously, the velocity of the stream AS 2.2 can be reduced to a minimum value when the velocity of the stream AS 1.2 reaches a maximum value, i.e., when the magazine filler MF should not admit cigarettes Z to the junction 32 except on the ground that such admission reduces the likelihood of damage to cigarettes in the region of the membrane 54.

Figure 2:
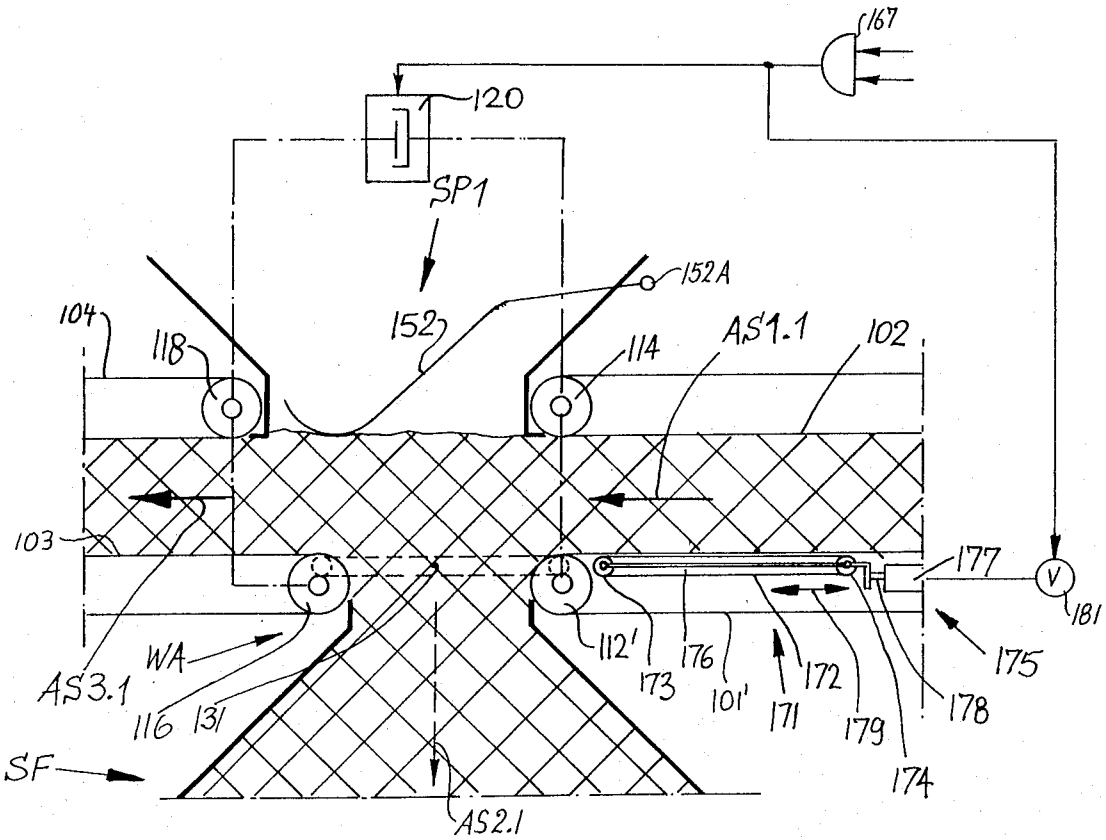
FIG. 2 is an enlarged detail view of a portion of a modified apparatus wherein the inlet to a tray filler can be sealed when the tray filler does not receive articles from the path along which the bulk of articles advances from the producing to the processing machine.

FIG. 2 shows a portion of a modified apparatus wherein all such parts which are identical with or analogous to corresponding parts of the apparatus shown in FIG. 1 are denoted by similar or identical reference characters plus 100 (this holds true for reference characters which consist exclusively of numerals). The belt conveyor 1 of FIG. 1 is replaced by a series of discrete belt conveyors 101' (only one shown in FIG. 2). The belt conveyors 101' are located one behind the other, as viewed in FIG. 2. Such discrete conveyors 101' are trained over discrete pairs of pulleys of which only one of several pulleys 112' is actually shown in the drawing. The composite belt conveyor including several conveyors 101' defines at least one slot which extends between the upper reaches of such conveyors and provides room for a carriage 176 supporting at least one pair of pulleys 173, 174 for at least one endless band 172 forming part of a closing or sealing device or closure 171 for the opening or inlet 131 of the tray filler SF below the switching device WA. If desired, the closing device or closure 171 can comprise several endless bands 172 each of which is disposed between two neighboring endless belt conveyors 101'.

The carriage 176 is reciprocable in directions indicated by a double-headed arrow 179 by a drive 175 including a fluid-operated motor, preferably a double-acting pneumatic cylinder and piston unit having a double-acting cylinder 177 and a piston rod 178 which is coupled to the carriage 176. The piston rod 178 can move the closure 171 between the solid-line and broken-line positions of FIG. 2. When the carriage 176 reaches the broken-line position, the upper reach or reaches of the band or bands 172 temporarily close the inlet 131 so as to prevent the tranfer of any cigarettes which form part of the stream AS 1.1 into the tray filler SF. In other words, all of the cigarettes which form part of the stream AS 2.1 then continue to travel over the closure 171 and form the stream AS 3.1 which advances toward the second switching device, not shown in FIG. 2.

The means for actuating the cylinder 177 of the drive means 175 comprises a valve 181 which can connect selected chambers of the cylinder 177 with a source of pressurized fluid, preferably a source wherein the pressure of fluid is relatively low so as to prevent abrupt movements of the carriage 176 between the solid-line and broken-line positions, such as could affect the condition or quality of cigarettes in the region of the inlet 131. The valve 181 is actuatable in response to signals from the AND gate 167 which, in turn, receives signals in the same manner as described in connection with FIG. 1. In other words, when the clutch 120 is engaged in response to a signal from the gate 167, the piston rod 178 of the drive 175 gradually shifts the closure 171 toward the broken-line position of FIG. 2 so as to ensure that all of the cigarettes which form the stream AS 2.1 are transferred into the passage between the belt conveyors 103, 104 which are then driven by the clutch 120. When the clutch 120 is deenergized, the closure 171 is retracted to the solid-line position of FIG. 2 so that the cigarettes which form the stream AS 1.1 are then converted into the stream AS 2.1 which flows through the inlet 131 and into the interior of the tray filler SF.

The parts 172 and 176 can be said to constitute a gate which is movable by the motor 177 to expose or seal the inlet 131.

When the apparatus embodies the closure 171 of FIG. 2, the velocity of the stream AS 2.1 is reduced to zero when the velocity of the stream AS 3.1 reaches the maximum value. A similar or analogous closure can be provided in the region of the membrane 54 (not shown in FIG. 2) in order to ensure that the velocity of the stream AS 2.2 can be reduced to zero when the velocity of the stream AS 1.2 reaches its maximum value.

Alternatively, the speed of the streams AS 2.1 and AS 2.2 can be reduced to zero in the absence of any closures, as long as the intervals of idleness of the tray filler SF and conveyors 8, 9 are very short or sufficiently short to avoid damage to cigarettes in the regions of the two junctions, i.e., as long as the intervals of idleness alternate in rapid sequence with intervals of operativeness of the tray filler SF and conveyors 8, 9.

The rate at which the magazine filler MF admits cigarettes Z preferably matches the rate at which the tray filler SF receives cigarettes Z via inlet 31 or 131 so that the quantity of cigarettes per unit length of the stream AS 3.2 matches the quantity of cigarettes per unit length of the stream AS 1.1 when the requirements of the packing machine PM match the output of the filter tipping machine FA. As mentioned above, the stream AS 2.2 enters the path which is defined by the conveyor system FS downstream of the inlet 31 or 131 to the tray filler SF.

An important advantage of the improved method and apparatus is that the rod-shaped articles which are withdrawn from the elongated path when the output of the producing machine FA exceeds the requirements of the processing machine PM is removed from such path and returned to the same path downstream of the locus of withdrawal. With reference to FIG. 1, this means that the surplus is withdrawn in the region of the switching device WA and is returned in the region of the switching device WZ. This is of advantage because the cigarettes which are withdrawn from that (first) portion of the path which accommodates the first switching device WA need not advance, again, between the conveyors 1, 2 and 3, 4 with attendant reduction of likelihood of any damage to such cigarettes. Instead, such cigarettes are readmitted into a second portion of the path (namely, into the path portion accommodating the switching device WZ) which is located downstream of the first portion.

When the rate at which the producing machine turns out cigarettes matches or closely approximates the rate of processing of such cigarettes, the rate at which the inlet 31 or 131 admits articles into the tray filler SF is extremely low or practically non-existent, as long as it suffices to ensure that one and the same group of stagnant articles is not held in contact with moving articles for a relatively long period of time such as could cause damage to the moving and/or stationary articles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of transporting multi-layer streams of rod-shaped articles of the tobacco processing industry to and from a junction, comprising the steps of conveying to the junction a first article stream; establishing and continuously maintaining at the junction a portion of a movable second article stream; conveying from the junction a third article stream past and in contact with the articles of said portion of the second stream; and at least intermittently moving the second article stream relative to the junction irrespective of the ratio of articles in the first and third streams so as to place a different portion of the second article stream into contact with the articles of the third article stream and to thus reduce the likelihood of damage to those articles of the second stream which are contacted by the articles of the third stream.

2. The method of claim 1, further comprising the step of increasing the speed of transport of one of the first and third streams to a predetermined maximum value and simultaneously reducing the second stream to a mere trickle so that the quantity of articles which are transported by the other of the first and third streams per unit of time approximates but is slightly less than the quantity of articles transported by the one stream per unit of time.

3. The method of claim 1 of transporting multi-layer streams of rod-shaped articles of the tobacco processing industry to and from said first mentioned as well as to and from a second jucntion, wherein the first stream is conveyed to the first mentioned junction, the third stream is conveyed from the first mentioned to the second junction and the second stream is diverted from the first mentioned junction, and further comprising the steps of establishing and maintaining at the second junction a portion of a movable fourth article stream, withdrawing from the second junction a fifth article stream and moving the articles of the fifth stream past and in contact with the articles of said portion of the fourth stream, and at least intermittently moving the fourth article stream with reference to the second junction so as to place the articles of a different portion thereof into contact with the articles of the fifth stream.

4. The method of claim 3, further comprising the step of introducing the articles of the second stream into successive empty trays.

5. The method of claim 3, further comprising the step of building the fourth stream from the contents of successive filled trays to thereby empty such trays.

6. The method of claim 5, wherein the contents of successive filled trays are evacuated at a first location and further comprising the steps of introducing the articles of the third stream into successive empty trays at a second location, transferring filled trays from said second to said first location, and transferring empty trays from said first to said second location.

7. The method of claim 1, wherein said first conveying step comprises conveying the first article stream to the junction at a variable rate.

8. The method of claim 1, wherein said second conveying step comprises conveying the third article stream from the junction at a variable rate.

9. The method of claim 1, wherein said establishing and maintaining step includes removing the articles of the second stream from the first stream when the first stream is larger than the third stream.

10. The method of claim 1, further comprising the step of merging the articles of the second stream into the third stream when the first stream is smaller than the third stream.

11. Apparatus for transporting multi-layer streams of rod-shaped articles of the tobacco processing industry, comprising a conveyor system which defines an elongated path; means defining in said path a stationary junction, said conveyor system comprising first conveyor means for delivering to the junction a first article stream along said path; means for establishing and continuously maintaining at said junction a portion of a second article stream, said conveyor system further comprising second conveyor means for advancing from the junction a third article stream past and in contact with the articles of said portion of the second stream; and means for at least intermittently moving the second stream relative to the junction irrespective of the ratio of articles forming the first and third streams so as to place the articles of a different portion of the second stream into contact with the articles of the third stream and to thus reduce the likelihood of damage to those articles of the second stream which are contacted by the articles of the third stream.

12. The apparatus of claim 11, wherein said establishing and maintaining means includes means for reducing the second stream to a trickle when the quantity of articles which one of the first and third streams transports per unit of time is increased to a maximum value so that the quantity of articles which the other of the first and third streams transports per unit of time rises to a value which is only slightly less than the maximum value.

13. The apparatus of claim 11, wherein said means for establishing and maintaining a portion of said second stream comprises a tray filler.

14. The apparatus of claim 11, further comprising a first machine which supplies the first stream and a second machine which receives the third stream.

15. Apparatus for transporting multi-layer streams of rod-shaped articles of the tobacco processing industry, comprising a conveyor system which defines an elongated path; means defining in said path a stationary junction, said conveyor system comprising first conveyor means for delivering to the junction a first article stream along said path; means for establishing and maintaining at said junction a portion of a second article stream, said conveyor system further comprising second conveyor means for advancing from the junction a third article stream past and in contact with the articles of said portion of the second stream; means for at least intermittently moving the second stream relative to the junction so as to place the articles of a different portion thereof into contact with the articles of the third stream; means defining in said path a second junction which is disposed downstream of said stationary junction, as considered in the direction of flow of the first and third streams, said second conveyor means being arranged to advance the third stream from the stationary to the second junction; means for establishing and maintaining at the second junction a portion of a fourth article stream, said conveyor system further comprising third conveyor means for removing from the second junction a fifth stream past and in contact with the articles of said portion of the fourth stream and for advancing the fifth stream along said path; and means for at least intermittently moving the fourth stream relative to said second junction so as to place the articles of a different portion thereof into contact with the articles of the fifth stream.

16. The apparatus of claim 15, wherein said means for establishing and maintaining a portion of said second article stream comprises a tray filler.

17. The apparatus of claim 16, wherein said means for establishing and maintaining a portion of said fourth article stream comprises a magazine filler.

18. The apparatus of claim 17, further comprising means for transferring filled trays from the tray filler to the magazine filler where the filled trays are emptied, and means for transferring empty trays from the magazine filler to the tray filler.

19. The apparatus of claim 15, wherein said means for establishing and maintaining a portion of said fourth article stream comprises a magazine filler.

* * * * *